US012044492B2

(12) United States Patent
Balhan et al.

(10) Patent No.: US 12,044,492 B2
(45) **Date of Patent: *Jul. 23, 2024**

(54) MAGAZINE LATCH

(71) Applicant: FN HERSTAL S.A., Herstal (BE)

(72) Inventors: Laurent Balhan, Mormont (BE); Dorian Delvaux, Oupeye (BE); Charles-Aurèle Gielen, Amay (BE); André Kartheuser, Malmedy (BE)

(73) Assignee: FN HERSTAL S.A., Herstal (BE)

( * ) Notice: Subject to any disclaimer, the term of this patent is extended or adjusted under 35 U.S.C. 154(b) by 0 days.

This patent is subject to a terminal disclaimer.

(21) Appl. No.: 18/040,308

(22) PCT Filed: Aug. 9, 2021

(86) PCT No.: PCT/EP2021/072146
§ 371 (c)(1),
(2) Date: Feb. 2, 2023

(87) PCT Pub. No.: WO2022/034014
PCT Pub. Date: Feb. 17, 2022

(65) Prior Publication Data

US 2023/0288158 A1 Sep. 14, 2023

(30) Foreign Application Priority Data

Aug. 14, 2020 (EP) ..... 20191152

(51) Int. Cl.
*F41A 17/38* (2006.01)
*F41A 35/06* (2006.01)

(52) U.S. Cl.
CPC ..... *F41A 17/38* (2013.01); *F41A 35/06* (2013.01)

(58) Field of Classification Search
USPC ..... 42/7
See application file for complete search history.

(56) References Cited

U.S. PATENT DOCUMENTS 4,326,353 A 4/1982 Ludwig et al.
4,949,492 A 8/1990 Clifton, Jr.
(Continued)

FOREIGN PATENT DOCUMENTS

FR 2513749 A1 4/1983

OTHER PUBLICATIONS

International Search Report and Written Opinion of the International Searching Authority from the European Patent Office, in PCT/EP2021/072146 dated Nov. 5, 2021, which is an international application corresponding to this U.S. application.

*Primary Examiner* — Reginald S Tillman, Jr.
(74) *Attorney, Agent, or Firm* — Kolitch Romano Dascenzo Gates LLC

(57) ABSTRACT

The present disclosure relates to an unlocking mechanism for a pistol magazine. Each of two release buttons is fastened to one end of a release lever controlling the translation of a lock cam arranged at the front or back of the handle. The lock cam includes a lock cooperating with an abutment surface arranged on the front or back surface of the magazine. A spring holds the lock cam in the lock position in the absence of pressure on the release button. Each release lever has a lug bearing on a corresponding lock cam lug of the lock cam. The lock cam is translated when one of the release buttons is actuated. The unlocking device has two release lever springs holding the release levers in the locked position, so as to make the left- and right-hand release buttons independent of each other.

5 Claims, 4 Drawing Sheets

(56) References Cited

U.S. PATENT DOCUMENTS

| | | | | |
|---|---|---|---|---|
| 11,480,403 | B2 * | 10/2022 | Balhan | F41A 35/06 |
| 2014/0230297 | A1 | 8/2014 | Larson, Jr. et al. | |
| 2019/0170462 | A1 | 6/2019 | Rieger et al. | |

* cited by examiner

MAGAZINE LATCH

FIELD

The present disclosure relates to a device for locking and releasing a magazine of a firearm, preferentially a pistol.

INTRODUCTION

Automatic and semi-automatic firearms powered by a magazine comprise means of locking the magazine whenever the weapon is used. In the case of a rifle or an assault rifle, the magazine is generally arranged in front of the trigger guard, such as in the case of conventional FN FNC or AK47 rifles, or behind in the case of a bullpup firearm. In such cases, the magazine lock control is generally arranged within the shell and requires one to move the hands when replacing the magazine.

In the case of semi-automatic handguns such as pistols, the magazine is generally arranged within the handle itself and is locked by means of a push-button which can be translated perpendicular to the handle and to the axis of the barrel to unlock the magazine. The magazine lock is arranged close to the normal position of the thumb during firing, so as to make possible an easy ejection of the empty magazine at the end of the firing sequence and reloading without modifying the firing position of the hand holding the handle.

The speed of replacing the magazine is further improved by the presence on the magazine board of a protuberance actuating a breech (or slide) stop holding the slide and/or the breech backwards after the firing of the last cartridge. The arresting of the breech backwards has the effect of indicating to the shooter that there is no cartridge left, and simplifies reloading, the breech being in position for reloading a new cartridge from a new magazine.

Nevertheless, this type of magazine lock has at least two drawbacks. On the one hand, the position and the type of movement by simple pressure of the thumb can lead to an untimely release of the magazine due to a wrong movement of the shooter, and on the other hand, the position of the thumb has to be adapted either to the right-handed or to the left-handed grip of the shooter.

SUMMARY

One of the goals of the present disclosure is thus to propose a magazine lock reducing the probability of unwanted release of the magazine. According to preferred embodiments of the present disclosure, the mechanism of the magazine lock mechanism allows for an ambidextrous use of the weapon concerned.

Ideally, ambidextrous devices should allow the release to be made from one side, without inducing any movement on the other side. Indeed, the activation button can be located under the palm or under the index finger of the opposite face, which could induce friction preventing an easy release of the lock.

The present disclosure relates to an unlocking mechanism for a pistol magazine comprising at least one release button arranged on the side of a handle into which a magazine can be inserted, each release button being fastened to one end of a release lever controlling the translation of a lock cam arranged at the front or at the back of the handle, said lock cam comprising a lock, cooperating in use with an abutment surface arranged on the front or the back surface of the magazine for locking or unlocking the magazine, at least one spring holding the lock cam in the locking position of the magazine in the absence of pressure applied on the release button.

According to preferred embodiments, the unlocking mechanism for the pistol magazine of the present disclosure includes at least one, or an appropriate combination of the following features:

- the mechanism comprises two release buttons arranged to the right and to the left of the handle, each release button being fastened to one end of a release lever controlling the translation of the locking cam, so as to unlock the magazine by actuating either the right-hand or the left-hand release button;
- each release lever includes a release lever lug bearing on a corresponding lock cam lug of the lock cam, the lock cam being translated when one of the release buttons is actuated;
- the mechanism includes a recoil spring for the lock cam, which holds the lock cam in the locked position, and two springs for release levers, which hold the release levers in the locked position, so as to make the movement of the left-hand and the right-hand release buttons independent of each other
- the lock cam is arranged at the back of the handle.

A second aspect of the present disclosure relates to a pistol comprising a mechanism for unlocking the magazine according to the present disclosure.

Preferentially, the pistol of the present disclosure comprises a frame guiding a slide and a shell covering said frame, the cam pin of the lock being fixed to the frame.

Advantageously, the frame is metallic whereas the shell is made of a polymer material.

NUMERICAL REFERENCES OF THE FIGURES

Figure 1:
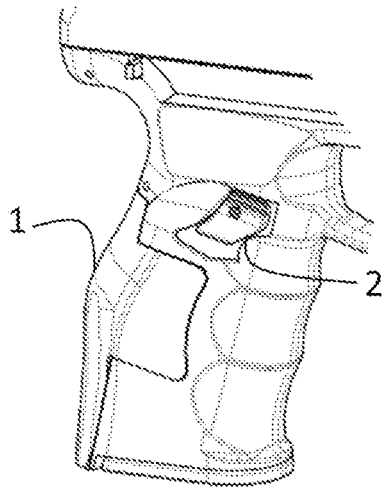
FIG. 1 shows an example of a pistol handle according to the present disclosure.

1. Handle
2. Right-hand release button
3. Magazine
4. Right-hand release lever
5. Left-hand release lever
6. Locking cam recoil spring
7. Lock cam lug
8. Lock cam
9. Left-hand release button
10, 18. Right-hand release lever lug

11. Lock cam pin
12. Right-hand release lever recoil spring
13. Lock cam lock
14. Detail shown in FIGS. 6 and 7
15. Magazine abutment surface
17. Magazine lock in translation
19. Magazine lock lug (in translation)
20. Left-hand release lever recoil spring
21. Right-hand release lever recoil spring
22. Magazine lock recoil spring in translation
23. Frame

DETAILED DESCRIPTION

The present disclosure relates to an unlocking mechanism for magazine, in particular an unlocking mechanism for a magazine integrated into a semi-automatic gun. The present disclosure represents an alternative to the lock described in the application PCT/EP2020/054624 made by the same applicant. The present application relates to the embodiments shown in FIGS. 3 to 7.

Figure 2:
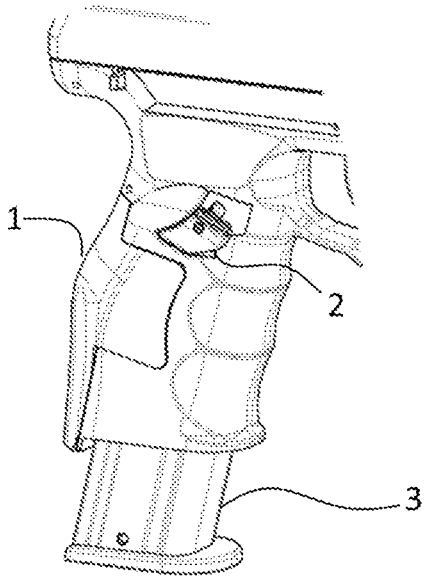
FIG. 2 shows the pistol handle of FIG. 1, in an unlocked position.

As shown in FIGS. 1 and 2, the release 2 of the magazine lock is arranged on the side of the handle 1. As shown in said figures, the unlocking release is obtained by moving the release 2 from the top downwards, and not by lateral pressure on a push-button. It is in this way possible to prevent a poorly controlled pressure of the thumb from unlocking the magazine 3, despite a position of the release 2 at a position normally occupied by the thumb of the shooter during the use of the weapon.

Figure 3:
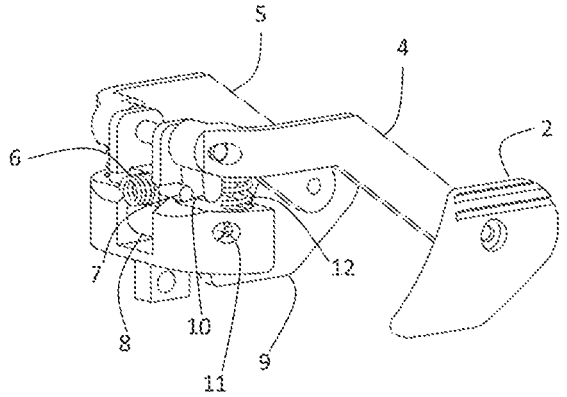
FIG. 3 shows a perspective view of an example of magazine lock, alternative to the present disclosure.
Figure 4:
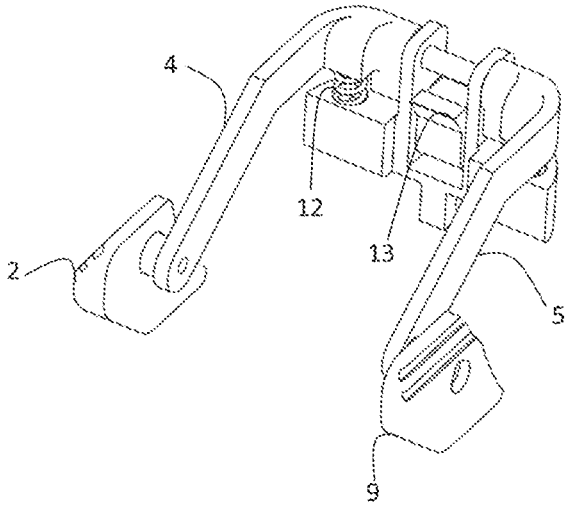
FIG. 4 shows another perspective view of the example of the magazine lock shown in FIG. 3.
Figure 5:
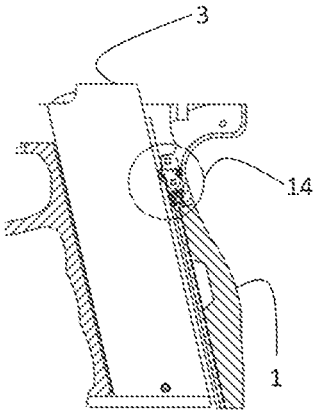
FIG. 5 shows a sectional view of a magazine handle comprising a magazine lock which is outside the present disclosure.
Figure 8:
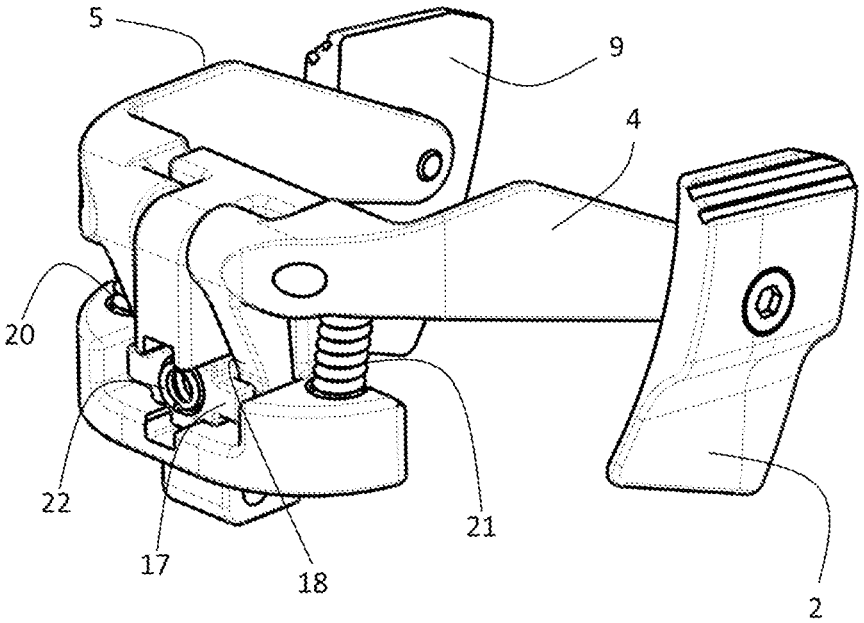
FIG. 8 shows an example of a mechanism for a magazine lock according to the present disclosure.

As shown in FIGS. 3 and 4, the release buttons 2,9 are arranged at the ends of two levers 4,5. The levers make it possible not only to position the release buttons 2,9 at the place providing the best ergonomics (distance between the back of the handle and the last phalange of the thumb), but also to increase the stroke needed for unlocking the magazine. A longer stroke reduces the likelihood of unwanted unlocking, whereas a shorter stroke improves the ease of use. Equivalent levers 4,5 are also present in the system of the present disclosure shown in FIGS. 8 and 9.

Of course, only one lever and release button could suffice for unlocking the magazine and would alone have the advantage of the upward and downward movement, and the determination of an adequate release stroke. Nevertheless, in such case, the weapon could not be easily adapted to all shooters and specific systems would be needed for the "right-handed" and for the "left-handed". Thus, advantageously, the lock according to the present disclosure comprises a release button on each side of the handle.

Figure 6:
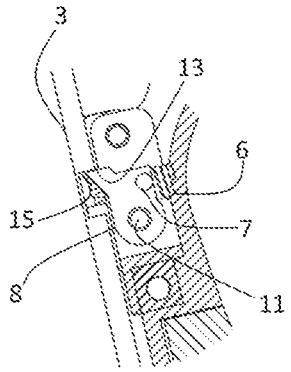
FIG. 6 shows an enlarged view of the zone 14 of FIG. 5, with the magazine locked.
Figure 7:
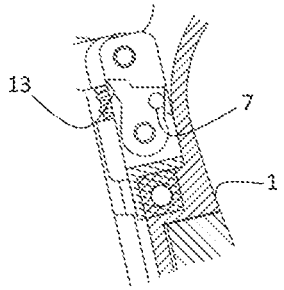
FIG. 7 shows an enlarged view of the zone 14 of FIG. 5, with the magazine locked.

As can be seen in FIGS. 6 and 7, in the alternative of the application PCT/EP2020/054624, the unlocking as such is obtained by the rotation of a cam 8 turning about an axis 11. The cam 8 comprises an abutment surface 13 cooperating with a corresponding abutment surface 15 on the back face of the magazine 3.

Figure 9:
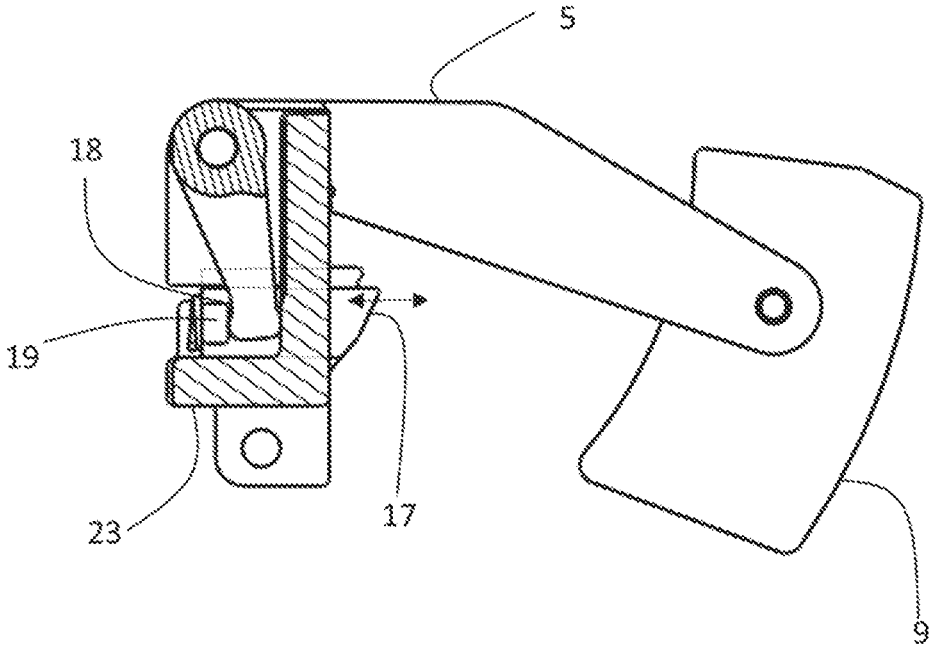
FIG. 9 shows a section of the system according to the present disclosure.

According to the present disclosure, the rotating cam 8 has been replaced by a cam 17 in translation, moving according to a movement represented by a double arrow in FIG. 9 (the hidden parts of the lock cam 17 are shown with dotted lines)

In the case of a rotating, non-ambidextrous mechanism comprising only one release button 2,9 and only one lever 4,5, the rotation of the lock cam 8 can be obtained simply by rigidly attaching the lever 4,5 to said lock cam 8. In such case, a single spring 6,12 acting either on the cam 8 or under the lever 4,5 suffices for returning the lock to the locked position after loading.

In the case of an ambidextrous mechanism, if the two levers 4,5 are rigidly attached to the cam 8, the two release buttons 2,9 will move jointly. Such joint movement can raise reliability issues if the button on the palm side of the hand of the shooter is located at the base of the index finger, or under a part of the palm exerting strong pressure on the corresponding button. Indeed, in such case, the pressure of the palm or of the base of the index finger could prevent the unlocking movement, or, worse, the return of the lock to the locking position. In such a case, it could be difficult to reliably replace a new magazine. Thus, advantageously, the two release levers 4,5 actuate the lock cam by simply pressing a release lever lug 10 on a corresponding lock cam lug 7 on the lock cam 8.

In the case of the lock 17 moving in translation, a surface 18 rigidly attached to each release lever 4,5 actuates the lock 17 by bearing on a lug 19 located on said lock 17. In the absence of pressure on the release levers 16, the lock 17 is held in position by a spring 22, and each release lever is held independently of each other by springs 20,21.

A person skilled in the art will easily understand that if the ideal usability is indeed obtained by placing the lock cam 17 at the back of the handle 1 (length of the levers substantially equal to the length of a thumb), such system could be transposed symmetrically to the front of the handle.

In many recent semi-automatic guns, the guiding function of movable parts in general, and the slide in particular, is decoupled from the grip function of the weapon by the use of a metal frame comprising rails on which the slide slides during the cycle of the weapon. A shell comprising the handle supports the frame. The handle comprises a magazine well into which the magazine is inserted. Advantageously, the lock cam 17 is guided by a housing provided in a part 23 of the frame and not in the shell, so as to improve the positioning of the head of the magazine (and thereby the positioning of the cartridge to be loaded) with respect to the slide, so as to prevent reloading problems during the cycle of the weapon.

The invention claimed is:

1. A pistol comprising an unlocking mechanism for a pistol magazine, comprising:

at least two release buttons (2) arranged to the right and to the left of a handle (1) into which a magazine (3) can be inserted, each release button (2,9) being fastened to one end of a release lever (4,5) controlling the translation of a lock cam (17) arranged at the front or the back of the handle (1);

said lock cam (17) comprising a lock, configured to cooperate in use with an abutment surface arranged on the front or the back surface of the magazine (3), so as to lock or unlock the magazine (3);

at least one spring (22) configured to hold the lock cam (17) in the magazine lock position in the absence of pressure on the release button (2,9); and each release lever (4,5) comprising a release lever lug (18) bearing on a corresponding lock cam lug (19) of the lock cam (17);

wherein the lock cam (17) is configured to be translated when one of the release buttons (2,9) is actuated and the unlocking device comprising two release lever springs (20,21) holding the release levers (4,5) in the locked position, so as to make the movement of the left-hand and right-hand release buttons (2,9) independent of each other.

2. The pistol according to claim 1, wherein the locking cam (17) is arranged at the back of the handle (1).

3. The pistol according to claim 1, comprising a frame guiding the slide and a shell covering said frame, the lock cam (17) being guided in a housing provided in a part of the frame (23).

4. The pistol according to claim 3, wherein the frame is metallic whereas the shell is made of a polymer material.

5. The pistol according to claim 1, wherein the locking cam (17) is arranged at the back of the handle (1), the pistol further comprising a frame guiding the slide and a shell covering said frame, the lock cam (17) being guided in a housing provided in a part of the frame (23).

* * * * *